US009965936B1

(12) United States Patent
Epps

(10) Patent No.: US 9,965,936 B1
(45) Date of Patent: May 8, 2018

(54) NETWORK COMMUNICATION AND ACCOUNTABILITY SYSTEM FOR INDIVIDUAL AND GROUP SAFETY

(71) Applicant: Shawn W. Epps, Belleville, IL (US)

(72) Inventor: Shawn W. Epps, Belleville, IL (US)

( * ) Notice: Subject to any disclaimer, the term of this patent is extended or adjusted under 35 U.S.C. 154(b) by 0 days. days.

(21) Appl. No.: 15/398,097

(22) Filed: Jan. 4, 2017

(51) Int. Cl.

| | |
|---|---|
| ***G08B 1/08*** | (2006.01) |
| ***G08B 21/02*** | (2006.01) |
| ***G08B 25/10*** | (2006.01) |
| ***G08B 13/00*** | (2006.01) |

(52) U.S. Cl.
CPC ..... *G08B 21/02* (2013.01); *G08B 13/00* (2013.01); *G08B 25/10* (2013.01)

(58) Field of Classification Search
CPC ..... G08B 21/02
USPC ..... 340/539.13
See application file for complete search history.

(56) References Cited

U.S. PATENT DOCUMENTS

| | | | | |
|---|---|---|---|---|
| 8,624,727 | B2 | 1/2014 | Saigh et al. | |
| 8,630,820 | B2 | 1/2014 | Amis | |
| 9,659,483 | B2 * | 5/2017 | Sager | G01N 33/0004 |
| 2007/0265796 | A1 * | 11/2007 | Taylor | G06F 17/30168 702/127 |
| 2012/0304172 | A1 * | 11/2012 | Greifeneder | G06F 9/45504 718/1 |
| 2013/0218456 | A1 * | 8/2013 | Zelek | G01C 21/3652 701/412 |
| 2014/0253326 | A1 * | 9/2014 | Cho | H04W 4/22 340/539.13 |
| 2014/0313032 | A1 * | 10/2014 | Sager | H04Q 9/00 340/539.17 |
| 2014/0320648 | A1 * | 10/2014 | Sager | H04Q 9/00 348/143 |
| 2016/0318476 | A1 * | 11/2016 | Cogill | B60R 25/30 |
| 2016/0342840 | A1 * | 11/2016 | Mullins | G06K 9/00671 |
| 2017/0177941 | A1 * | 6/2017 | Mullins | G06K 9/00671 |
| 2017/0186309 | A1 * | 6/2017 | Sager | G08B 29/188 |
| 2017/0192089 | A1 * | 7/2017 | Parker | G01S 3/782 |

* cited by examiner

*Primary Examiner* — Santiago Garcia
(74) *Attorney, Agent, or Firm* — Dunlap Bennett & Lundwig PLLC

(57) ABSTRACT

A safe network system is provided, wherein the safe network system communicatively couples to proximate peripheral and adjunct devices for identifying threats, sending threat alerts, providing routes to safe locations in threatened areas, and checking in on network users during and after the identified threat.

15 Claims, 11 Drawing Sheets

A INACTIVE USER
B ACTIVE USER
T THREAT
D USER IN DANGER
E USER NEAR DANGER
C CAR INACTIVE
F CAR ACTIVE
G CAR IN DANGER
H CAR NEAR DANGER

NETWORK COMMUNICATION AND ACCOUNTABILITY SYSTEM FOR INDIVIDUAL AND GROUP SAFETY

BACKGROUND OF THE INVENTION

The present invention relates to networked computer environments and, more particularly, to a network communication and accountability system for individual and group safety.

Current safety systems and the systemic devices coupled thereto have the following disadvantages: people not knowing where to go when a crisis strikes quickly or safest route to take; people not knowing where the threat or threats are coming from; people not knowing the type of threat or threats quickly; people not knowing who is in the proximity of the threat or threats; people not knowing how many people are in the proximity of threat; people not knowing if someone is in route to provide aide if needed; people not being able to account for all people after a threat quickly and accurately; the associated safety devices not authenticating their users; the lack of ability to mobilize large crowds of people quickly in the event of a crisis; not being able to get people up to date information quickly on a crisis situation to include family and friends who are not in the situation; they do not know-how regarding how to react to a crisis situation in an area that is foreign to a person; not able to automatically send out notification and alerts to people if user/user-device does not respond (for example, a user is incapacitated, as manual safety alerting systems require users to press a button don't account for such incapacitation); not able to record or monitor crisis events automatically and send that information automatically; not able to discretely send alerts and notifications when a person is in danger; manual safety systems that require users to provide their own updates and modification may not be properly updated and become obsolete; lack of a safety network, which encompasses mobile and stationary electronic devices with WiFi, Bluetooth or RFID capability, and so tying many individual systems together to create one network, thereby providing quick notification to local users and loved ones via gaming systems, smart watches, PCs and mobile devices; not allowing users to be quickly added to local safe networks so as to be provided updates as a crisis arises; lacking a way to allow other safety systems to be integrated into their system; lacking global notifications to notify all users or just users in close proximity; requiring all users to have a proprietary system to participate; not utilizing check-ins as the core of their individual application; lacking a gun safety device integrated into the system; lacking a safety chip that can be attached to clothing or devices; not allowing for audio and video recordings to be sent automatically; peripheral devices are not part of these systems that provide enhancement and discrete notifications; alerts are not able to be activated by safe word or Db levels; do not use heart rate technology to sense when users are in danger; do not utilize control devices for emergency responders; do not provide confirmation that help is on the way; not enough emergency responders to protect all the citizens; do not provide safety for individuals and business.

In other words, current systems do not incorporate all electronic devices capable of receiving or sending alerts. They don't utilize all devices that have the capability to receive or send messages electronically or Analog, Digital, WiFi, Satellite, or RFID. They rely on the users to manually add data or initiate alerts. They don't authenticate the user or utilize bio metric data or safe word recognition. They don't provide instructions specific to the crisis and how to react to particular threats. They don't identify the type of threat where the threat is coming from and safe locations for users to go. They don't provide an automated way to account for all users after a crisis and focus on those who are in need of help. They don't automatically update emergency contacts to ensure users have people who can respond within a short period of time. Current systems don't provide an automated way for users to quickly update emergency contacts as they travel to ensure they have contacts that are within 30 mins of their current location that can provide support. Once users setup up their emergency contacts they have to manually change them or add new ones every time. They don't utilize new emerging technology such as Quad Copters, or other unmanned electronic mobile devices. The don't utilize voice and facial recognition software to tag threats or locations as being unsafe or identify potential threats.

Therefore, current safety systems and device do not work well because they focus on blasting out information to everyone and not just those who are impacted. They rely on the users to update information and initiate alerts, rather than automatically providing users with safe locations and needed information quickly. Without user authentication capabilities utilizing up to date captured images, how do current systems know who is checking in, who to look for, or what they look like.

As can be seen, there is a need for a network communication and accountability system for individual and group safety, which incorporates all wireless forms of communication, utilizes bio metric data for authentication, sends alerts regarding safe locations, provides manual alert activation, automated alert activation, safe words to check in, and discrete alerting to emergency contacts that or in the local area. The present invention also tags potential threats utilizing voice and facial recognition software; utilizes device and gesture recognition software to identify threats or potential threats; utilizes UAVs armed with the latest technology to provide safety to users utilizing audio, visual devices to record and activate alerting when necessary. All safety network devices work together to seamlessly provide a complete safety network for users, wherein the system sends and receives alert notification from any electronic device that has electronic signal capabilities such as WiFi, Bluetooth, RFID, and Satellite. The present invention is also adapted to authenticate users and utilizes GPS and IPS data to locate people in danger.

SUMMARY OF THE INVENTION

In one aspect of the present invention, a method of providing a safe network system includes prompting a plurality of peripheral computing devices and a plurality of adjunct devices to communicatively link to a network that includes at least one server, wherein prompting each device is based in part on a predetermined proximity to the network; associating a user with each peripheral computing device; the plurality of adjunct devices providing a plurality of sensors configured to identify at least one threat based on audio, visual and motion related data captured by the plurality of sensors; the plurality of peripheral computing and adjunct devices providing GPS and IPS technology to locate at least one identified threat; and configuring each peripheral computing device for communicating a plurality of threat alerts regarding and routes to a safe location relative to each identified threat.

In another aspect of the present invention, the method of providing a safe network system includes prompting a plurality of peripheral computing devices and a plurality of adjunct devices to communicatively link to a network that includes at least one server, wherein prompting each device is based in part on a predetermined proximity to the network; associating a user with each peripheral computing device; the plurality of adjunct devices providing a plurality of sensors configured to identify at least one threat based on audio, visual and motion related data captured by the plurality of sensors, wherein the plurality of sensors comprises at least one of a group including motion sensor, a Db sensor, a light sensor, an audio sensor, and a video sensor; the plurality of peripheral computing and adjunct devices providing GPS and IPS technology to locate at least one identified threat; configuring each peripheral computing device for communicating a plurality of threat alerts regarding and routes to a safe location relative to each identified threat; and providing a roll calling functionality based upon at least a status of the at least one identified threat, wherein the plurality of peripheral computing devices is prompted for a response, and wherein the roll calling functionality automatically terminates only when each peripheral computing device communicates the response, wherein the at least one server automatically determines each safe location based on a spatial relationship between a respective peripheral computing device and the located position of the at least one identified threat, wherein each adjunct device automatically communicates at least one of the plurality of threat alerts based in part on a breach of a predetermined threat threshold defined by the audio, visual and motion related data captured by the plurality of sensors, and wherein the at least one server automatically upgrades at least one of the plurality of threat alerts to a notification to emergency responders based in part on the predetermined threat threshold.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a safe network system communicatively coupled to peripheral and adjunct devices for identifying threats, sending threat alerts, providing routes to safe locations in threatened areas, and checking in on network users during and after the identified threat.

Figure 1:
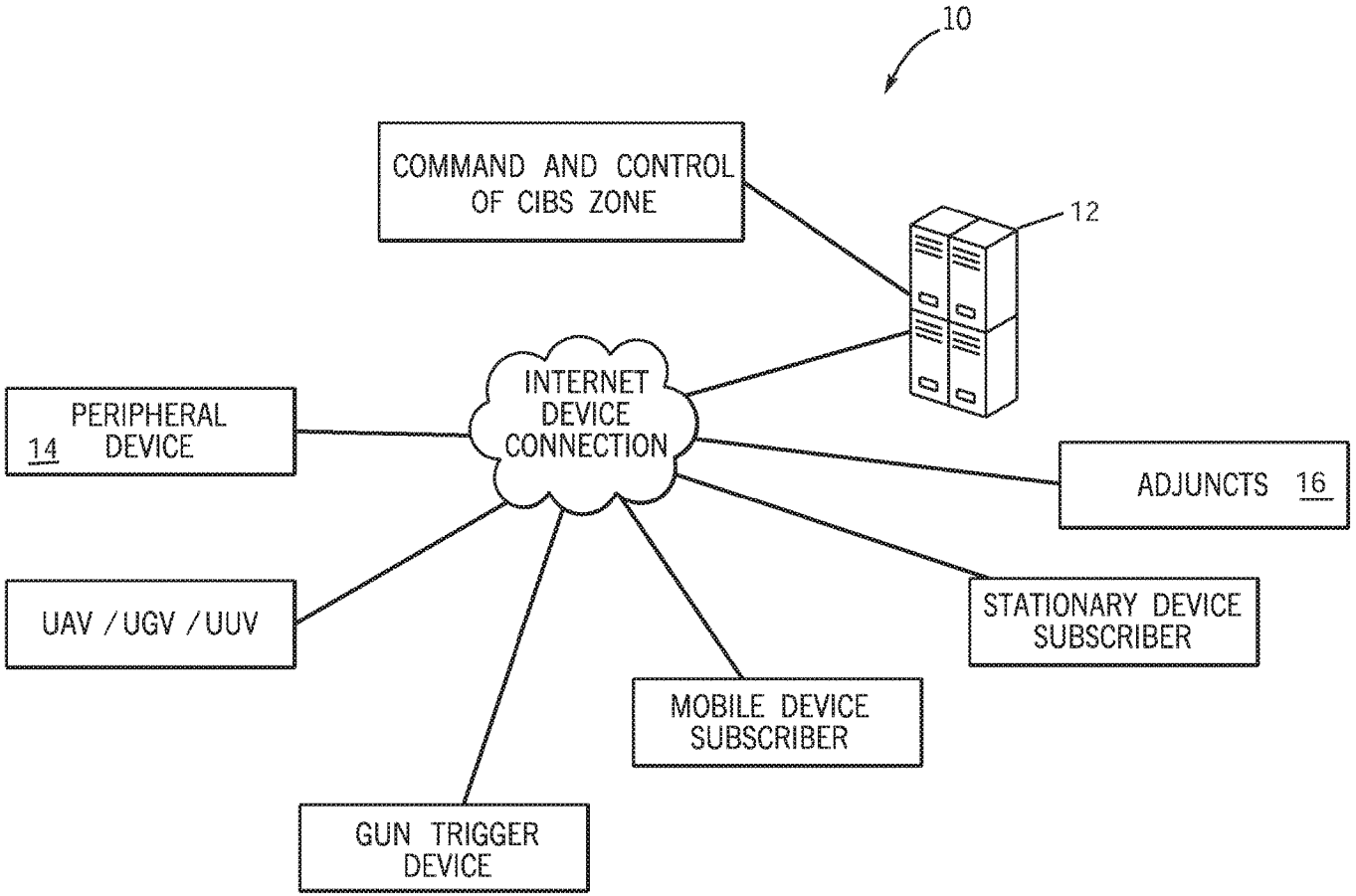
FIG. 1 is a block diagram of an exemplary embodiment of the present invention.
Figure 2A:
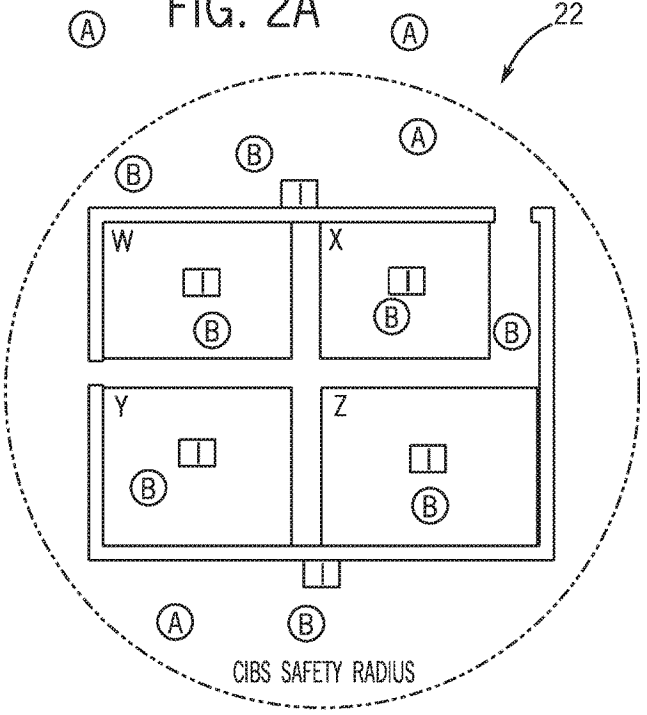
FIG. 2A is a floor plan view of an exemplary embodiment of the present invention, demonstrating a "normal" mode.
Figure 2B:
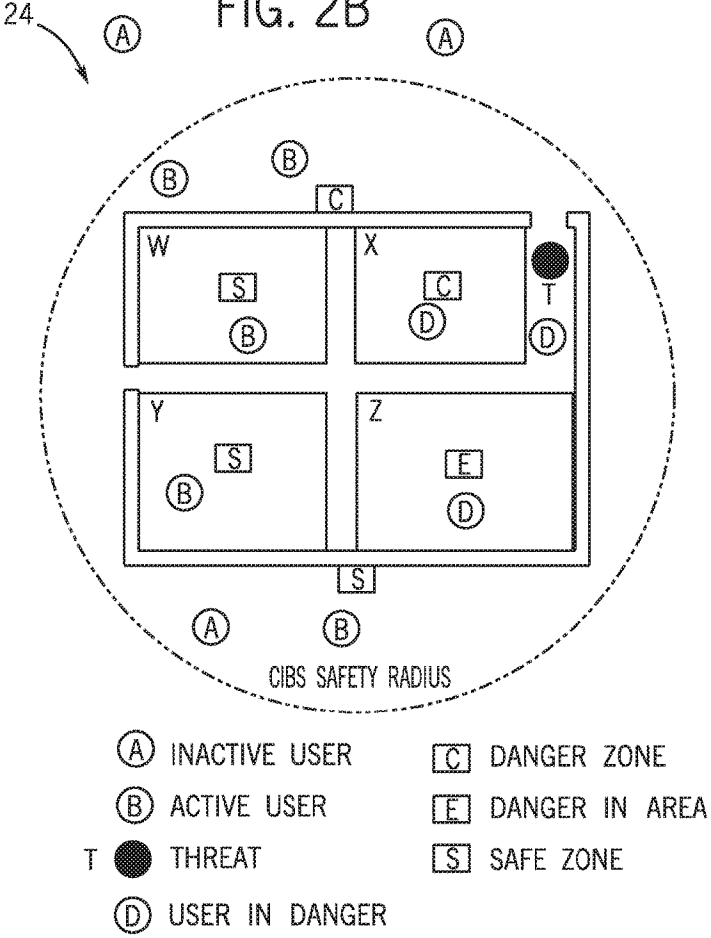
FIG. 2B is a floor plan view of an exemplary embodiment of the present invention, demonstrating a "threat" mode.
Figure 2C:
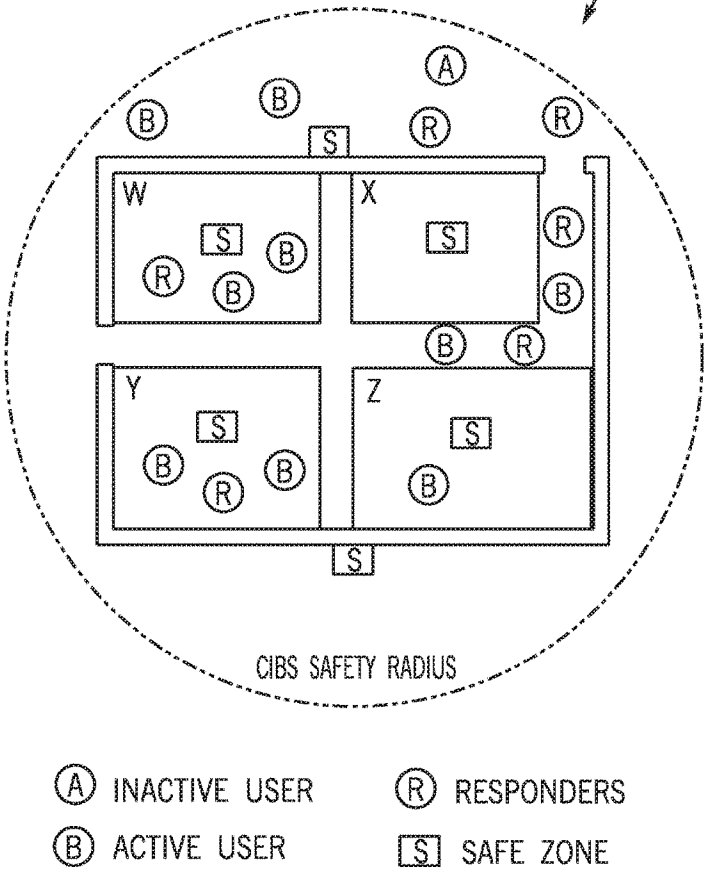
FIG. 2C is a floor plan view of an exemplary embodiment of the present invention, demonstrating a "threat neutralized" mode.
Figure 2D:
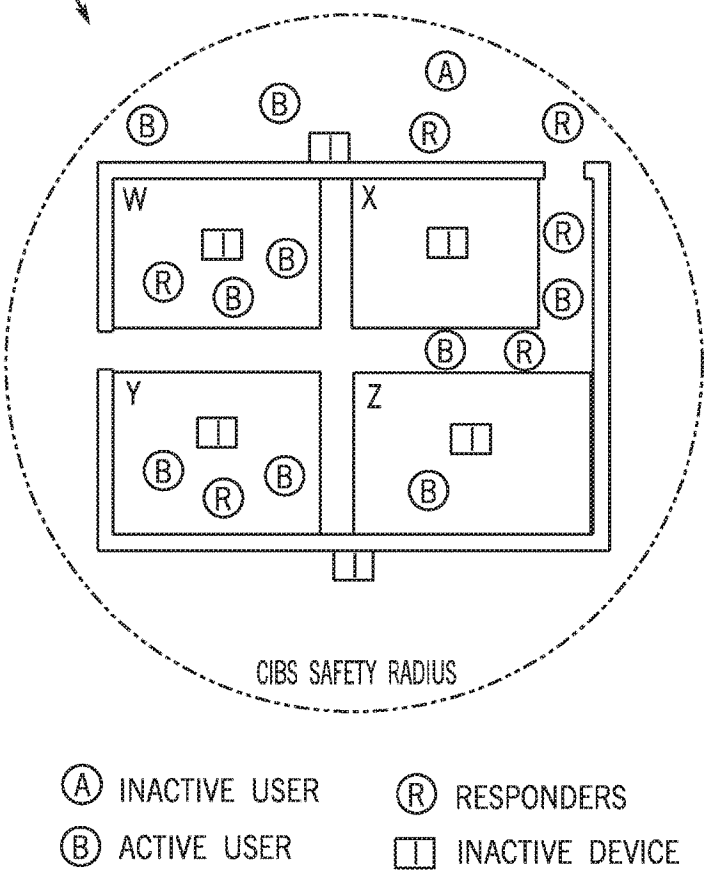
FIG. 2D is a floor plan view of an exemplary embodiment of the present invention, demonstrating a "are secured" mode.
Figure 3A:
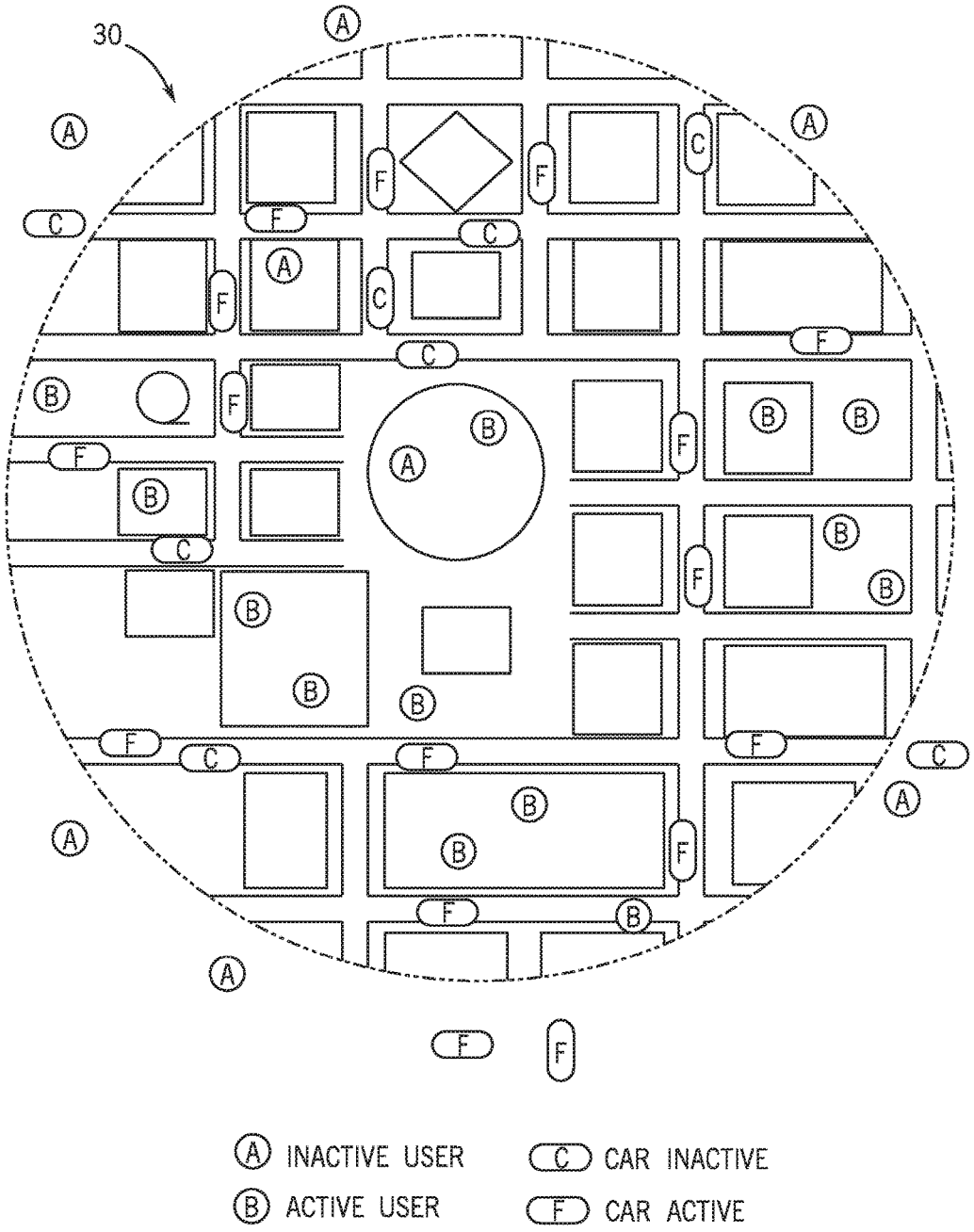
FIG. 3A is a map plan view of an exemplary embodiment of the present invention, demonstrating a "normal" mode.
Figure 3B:
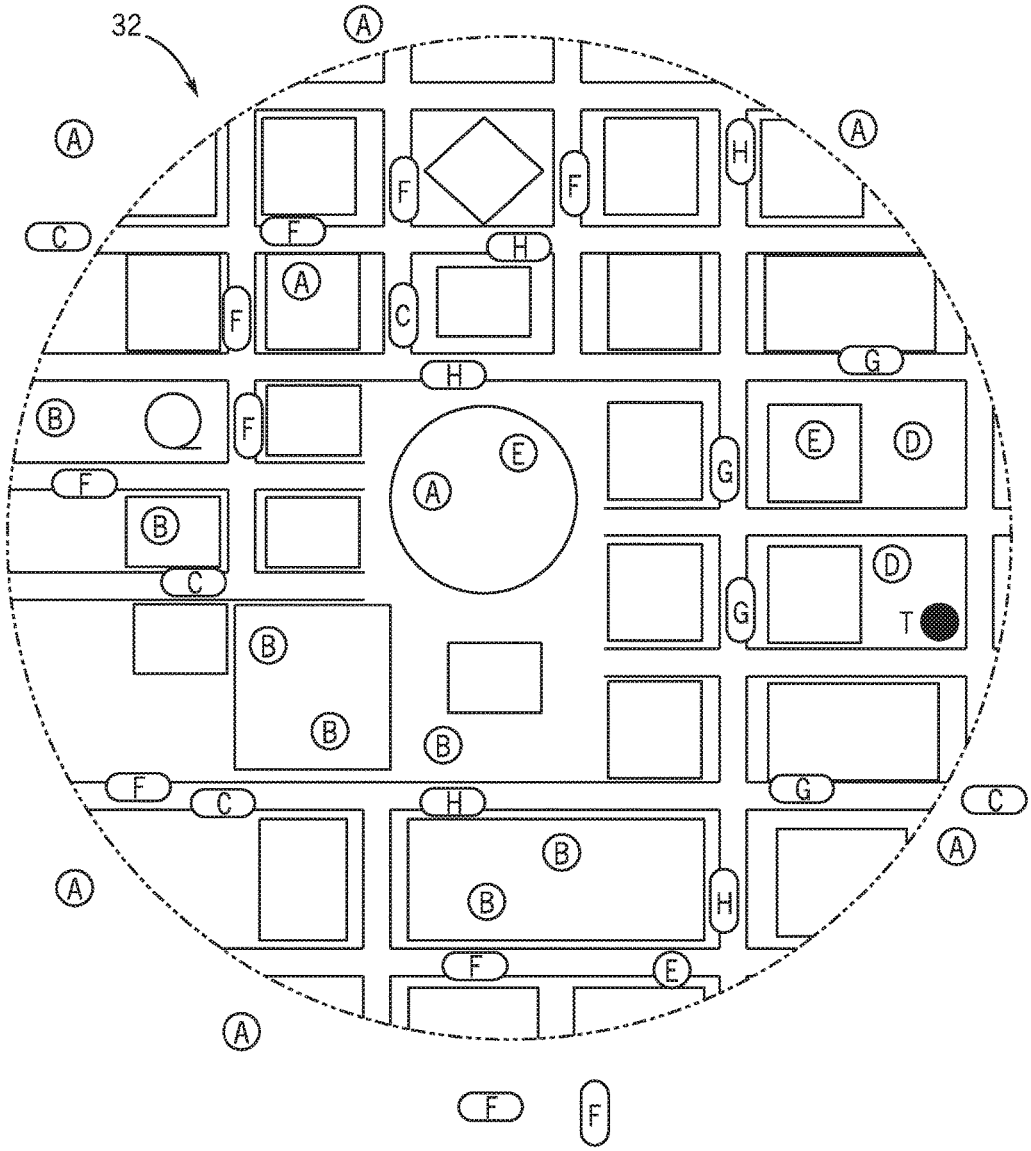
FIG. 3B is a map plan view of an exemplary embodiment of the present invention, demonstrating a "threat" mode.

Referring to FIG. 1, the present invention may include at least one computing device with a user/administration interface. Each computing device may include at least one processing unit coupled to a form of memory. Each computing device may include, but not be limited to, a server, a microprocessor, a desktop, a laptop, a smart device, such as a tablet, a smart phone, smart watch, or the like. The computing device may include at least one program product including a machine-readable program code for causing, when executed, the computing device to perform steps. The program product may include software which may either be loaded onto the computing device or accessed by the computing device. The loaded software may include an application on a smart device, a server, and/or the like. The software may be accessed by the computing device using a web browser, the Internet, extranet, intranet, host server, internet cloud, wifi network, WiFi, Bluetooth, RFID technology, and the like.

The present invention provides a standalone and/or integrated safe network system 10 by installing a server software application on the computer/servers 12 and at least one application software on adjunct devices 16 and peripheral computing devices 14. The at least one application software may include a roll call application software, a control device application software, an individual mobile application software, and the like. Once the at least one application software is downloaded to its respective device, the device is "active" and enabled to be coupled to and communicative with the safe network system 10 and its networked devices.

The safe network system 10 may include a user/administration interface for command and control of the software applications and thus the computer/servers 12, adjunct devices 16 and peripheral computing devices 14 adapted to communicate with each other so that the safe network system 10 interpret information received, selectively translate and transmit data between the server 12 and devices 14 and 16 as needed. Peripheral devices 14 may, mobile phones, smart watches, tablets, electronic chips, safety watches, safety electronic bands, and any other device that is mobile and has the capability to communicate using WiFi, Bluetooth, RFID technology or the like so as to receive and send notifications and alerts to and from the computer/servers 12, wherein such notifications and alerts may be automatically triggered or manually activated.

Adjunct devices 16 may utilize a plurality of sensors, such as motion sensors, Db sensors, light sensors, and video to locate and identified threats based on sound, motion and visual data captured. Adjunct devices 16 may include video cameras, security alerting and notification devices having WiFi, Bluetooth, RFID technology and the like to receive and send information.

Adjunct devices 16 may be adapted to selectively communicate threat alerts when one of the plurality of sensors is triggered by a breach of a predetermined threat threshold. Such threat thresholds can be modified by application software connected terminals, via the administrator interface, or at the actual devices. Similarly, the safe network system 10 may be adapted to capture geographical data using GPS and IPS functionality embodied in adjunct and/or peripheral computing devices 16 and 14 so as to locate all personal and identified their position in regards to an identified threat or perceived threats.

If a threat alert is triggered or a manually initiated, all networked devices receive alerts and notifications. For example, a user enters a facility that is protected by the safe network system 10 of the present invention, and subsequently the user gets into an altercation therein, networked adjunct devices 16 are configured to engage their sensors to collect threat data by picking up the vocal argument, providing voice recognition, capturing video and still images of the altercation for facial recognition and evidence, and transmitting a threat alert based on the respective threat thresholds of each adjunct devices 16. This threat alert along with the threat data captured is sent to the computer/servers 12 and its server application. This threat data may be viewed by an administrator or may follow the automated response designated for the type of threat. In this case, it might be monitored for identifying the type of threat. While identifying the threat, the threaten location has been tagged as a potential threat all personal are directed to stay clear of the threatened location via their peripheral devices 14. The threated area is marked by the safety alert device displaying a yellow LED and those in close proximity reflecting the same.

Similarly, adjunct devices 16 may be utilized to capture additional threat data, such as audio, of the situation automatically or manually. For example, if a threat makes a threatening gesture that is captured by an adjunct device 16, said adjunct device 16 may upgrade a related threat alert, which in turn initiates an alert notification to emergency responders. The present invention may also notify users of the proximity of the threat, and route such users to designated safe locations. If a threat has been neutralized an all-clear notification may be sent to all adjuncts and peripheral computing devices 16 and 14, setting all networked adjuncts devices 16 back to default status. The roll call modality may then be initiated automatically or manually by an administrator, wherein all users are prompted to identified themselves, and wherein the system goes back to a default state with no active alerts after all prompted user have been identified.

During an identified threat, the safe network system 10 may be adapted to prompt all peripheral devices 14 unconnected to network (non-networked devices) that are in a predetermined proximity of the identified threat, enabling peripheral computing devices 14 to join the safe network system 10 (or local networks) quickly for receiving alerts, notifications and helpful information, whereby additional peripheral computing devices 14 may use their sensors and GPS and IPS technology to collect threat data and to provide alerts and notifications to other peripheral computing devices 14 coupled to the network system.

In the absence of an identified threat, the safe network system 10 may send invitation/join request on set intervals to all peripheral computing devices 14 unconnected to the safe network system 10 that are in a predetermined proximity thereof, wherein the invitation/join request enables such devices 14 and 16 to join the safe network system 10 quickly. Networked devices may receive alerts and notifications. The safe network system 10 may provide automated and manual status updates, alerts, and notifications to networked peripheral computing devices 14 in a timely manner. The safe network system 10 may receive status updates, alerts and notifications from networked peripheral computing and adjunct devices 14 and 16. The safe network system 10 may disconnect networked peripheral computing devices 14 outside of the predetermined proximity. Networked and disconnected devices receives notification to that effect. Thereby, the safe network system 10 provides accountability of all users connected to the safe network system 10 quickly and identifies those in need of assistance.

Process of Joining the Safe Network System 10

Figure 4A:
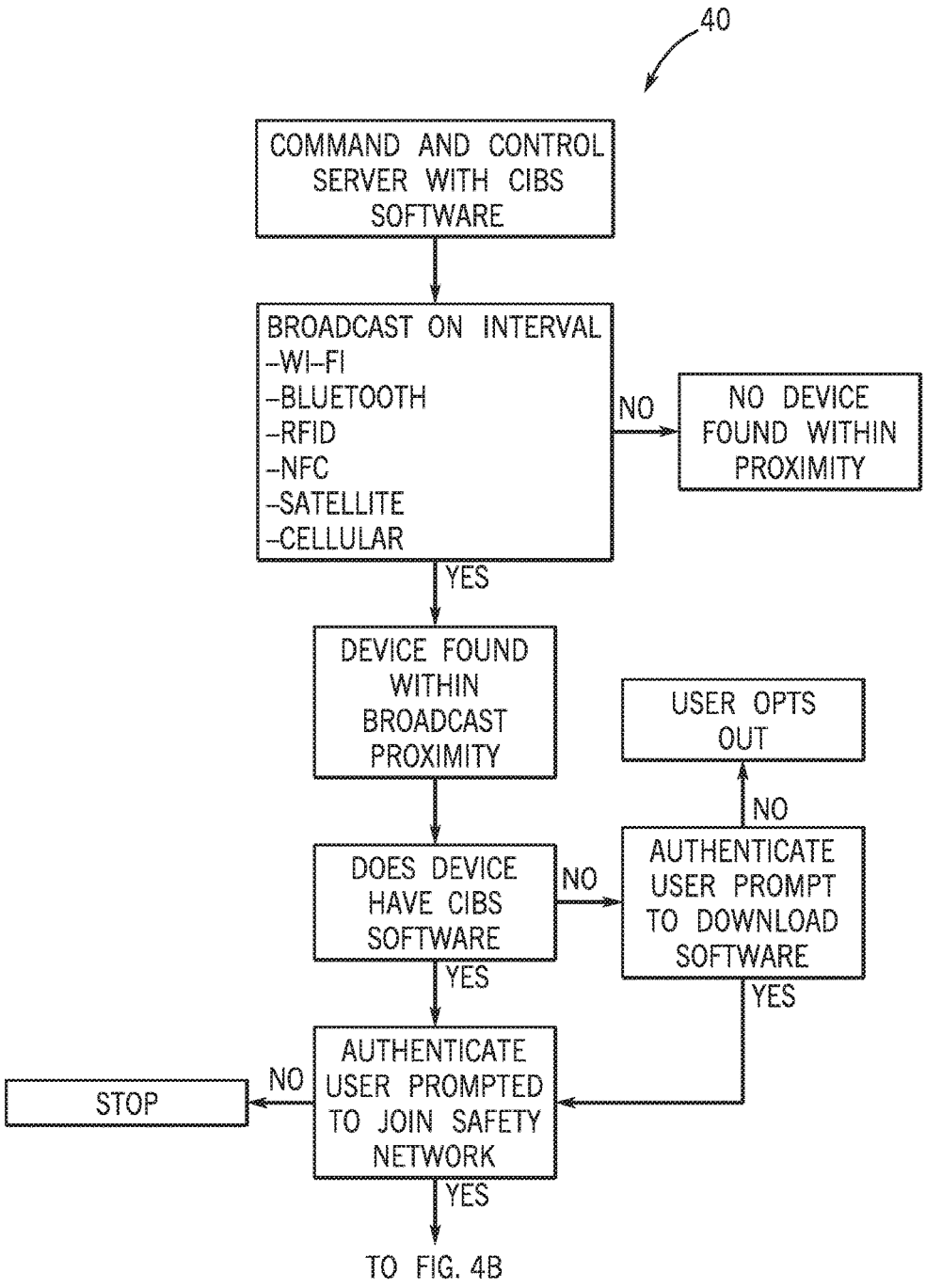
FIG. 4A is a flow chart of an exemplary embodiment of the present invention.
Figure 4B:
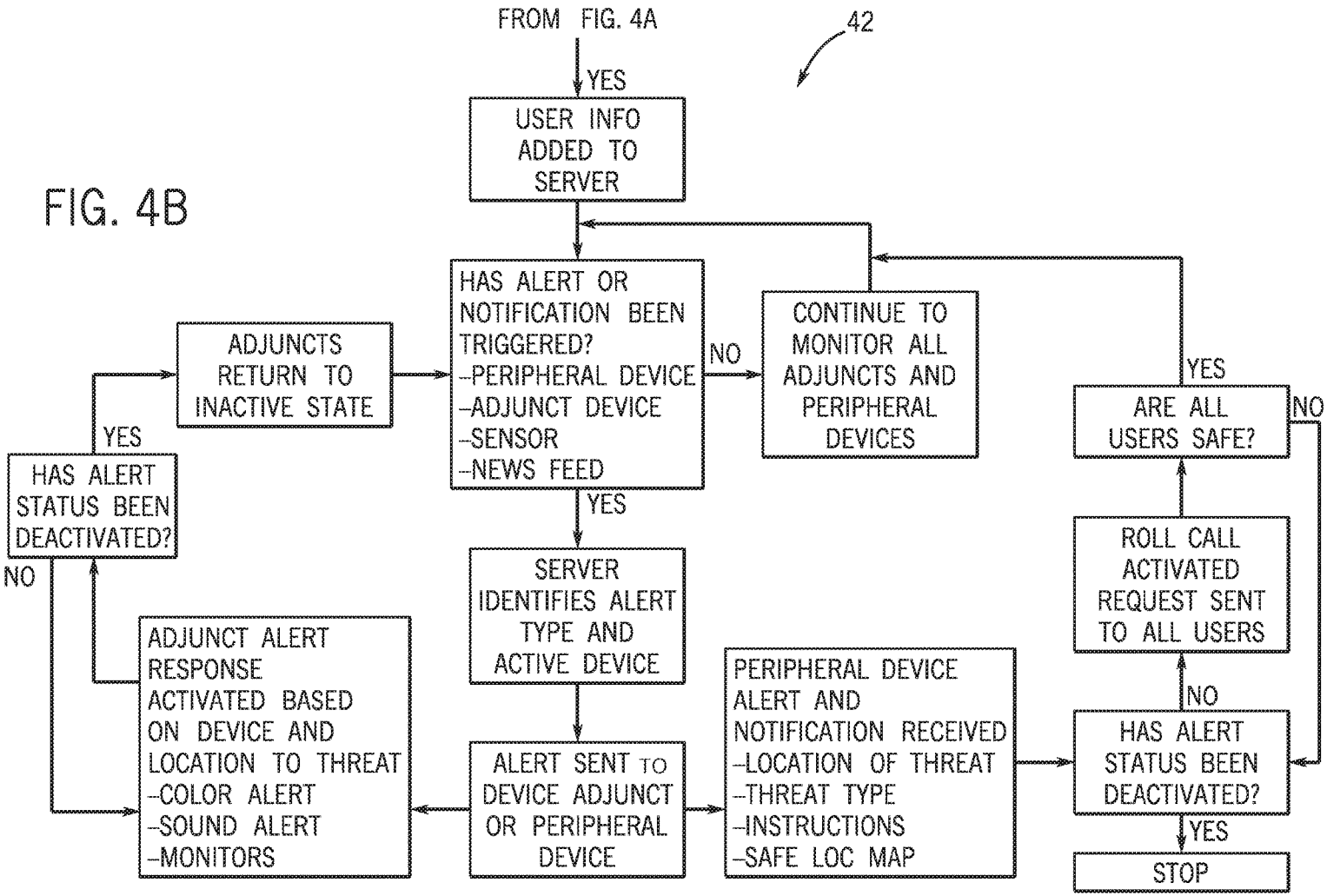
FIG. 4B is a continuation of the flow chart of FIG. 4A.
Figure 5:
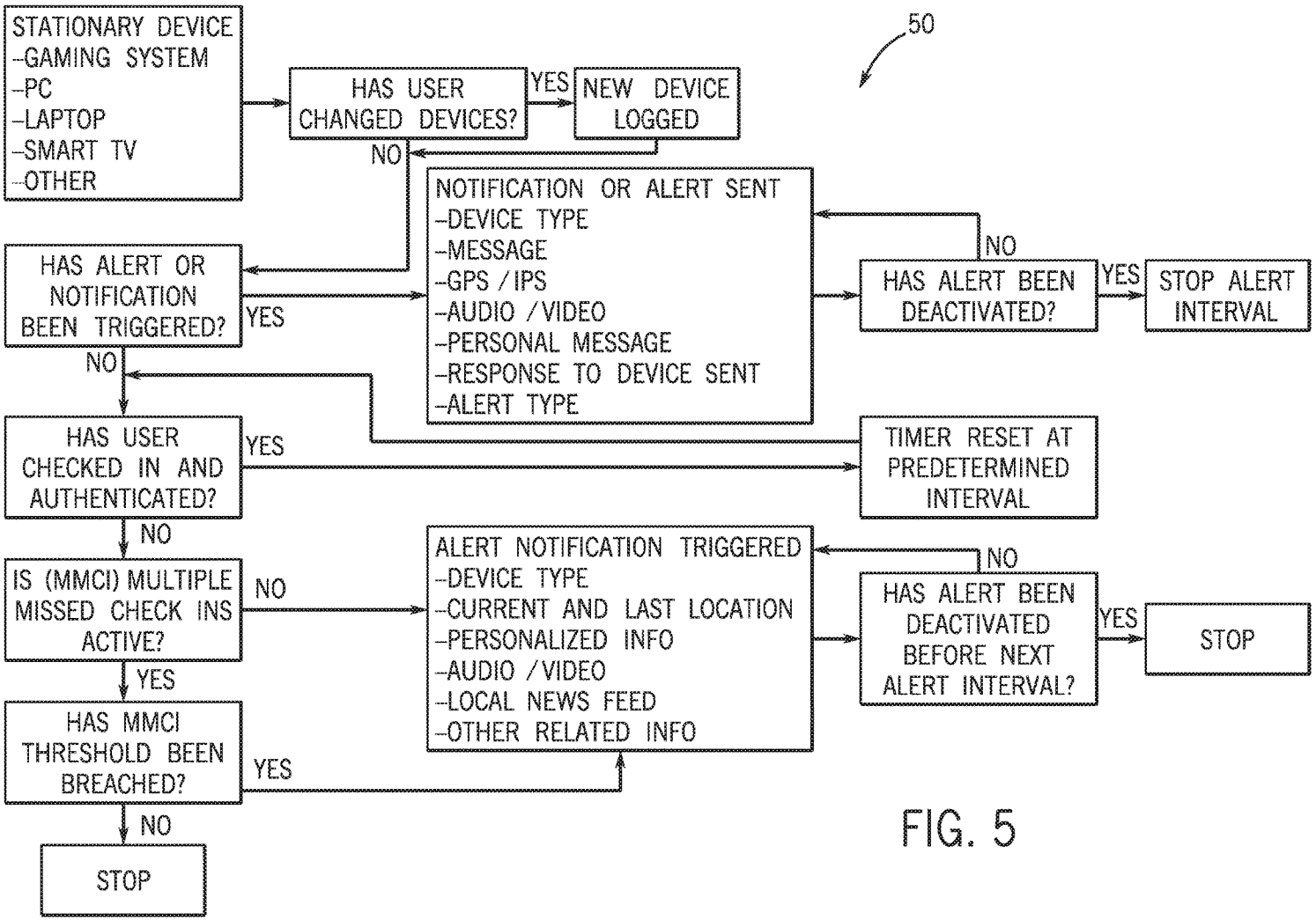
FIG. 5 is a flow chart of an exemplary embodiment of the present invention.
Figure 6A:
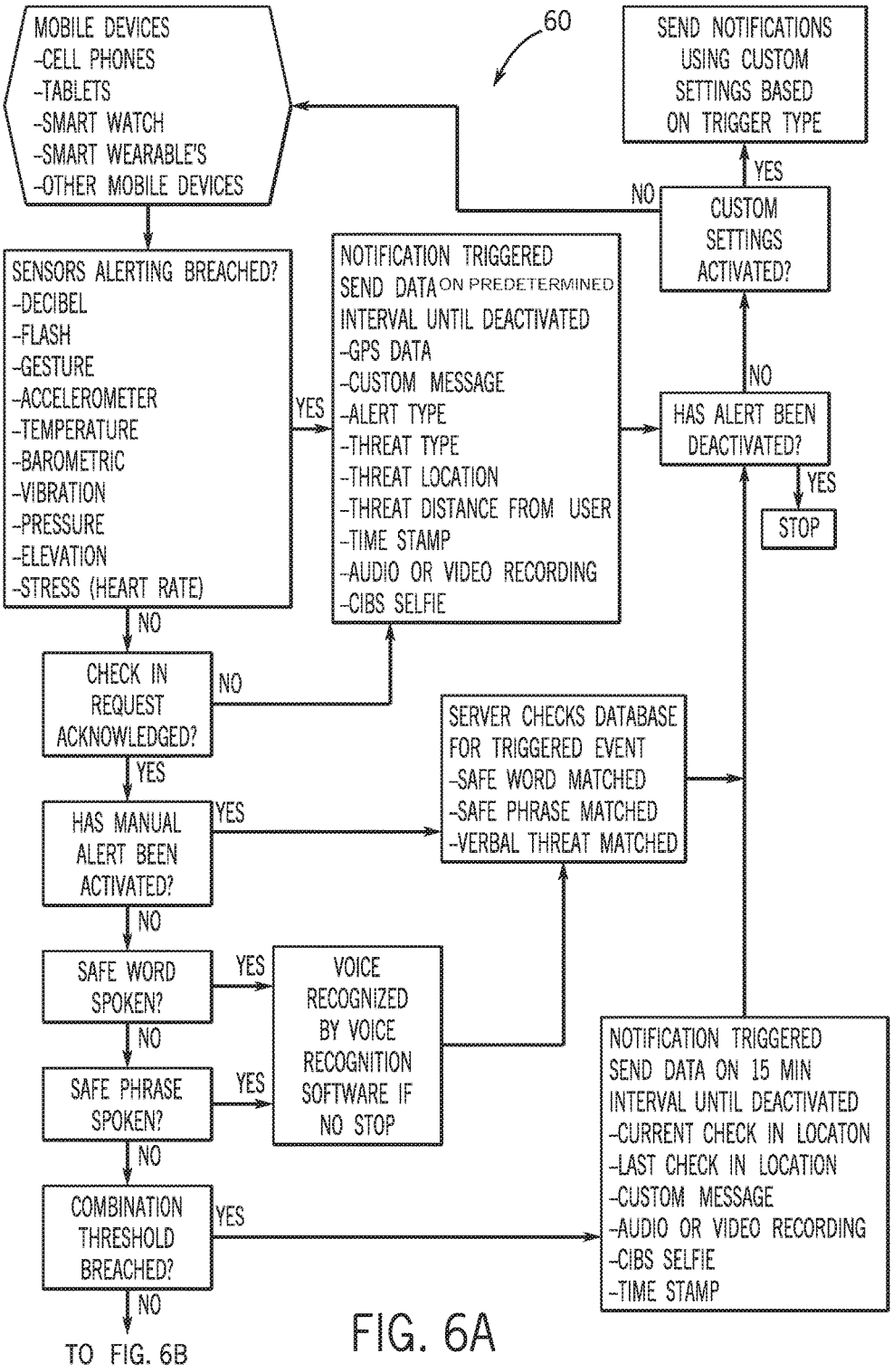
FIG. 6A is a flow chart of an exemplary embodiment of the present invention.
Figure 6B:
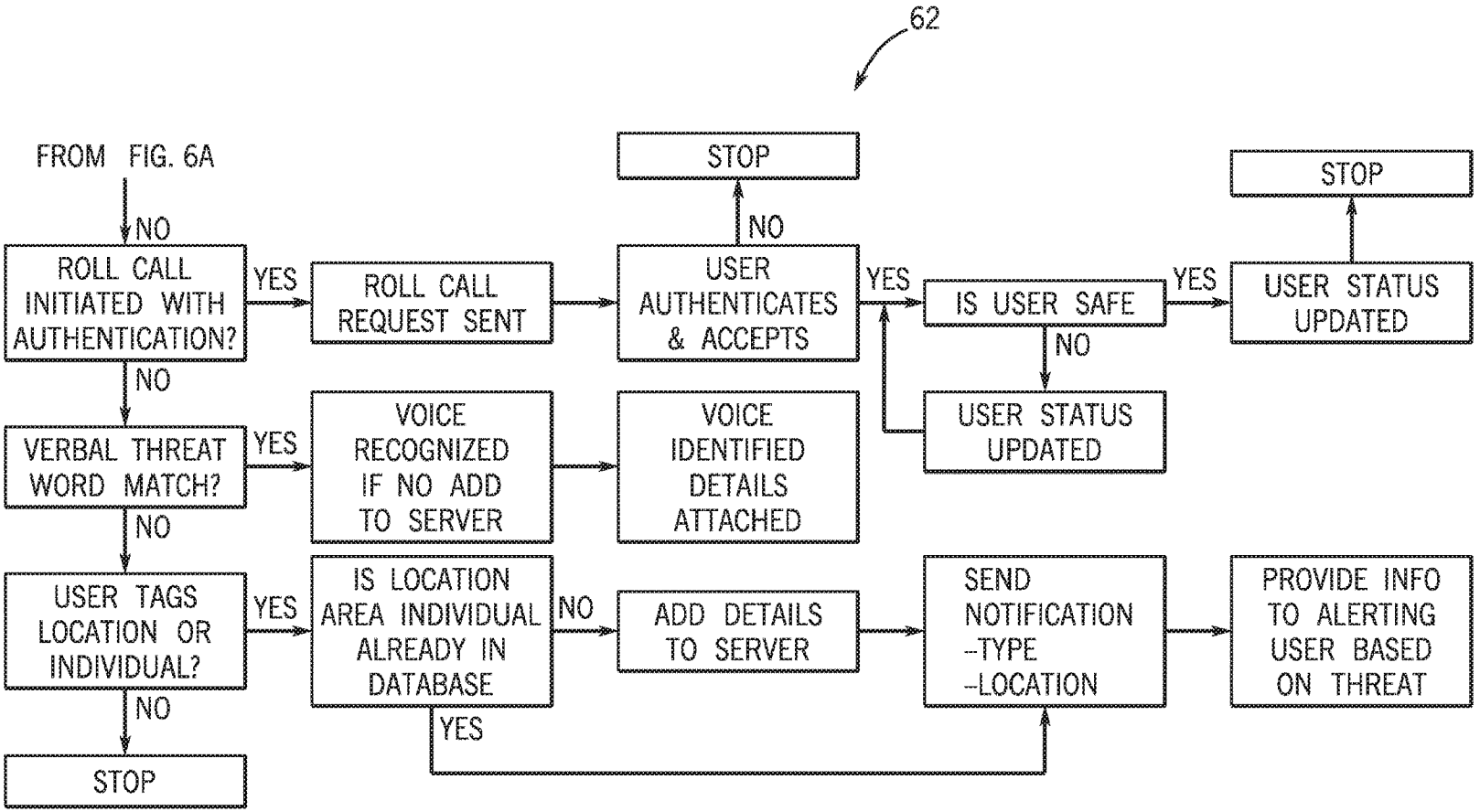
FIG. 6B is a continuation of the flow chart of FIG. 6A.
Figure 7:
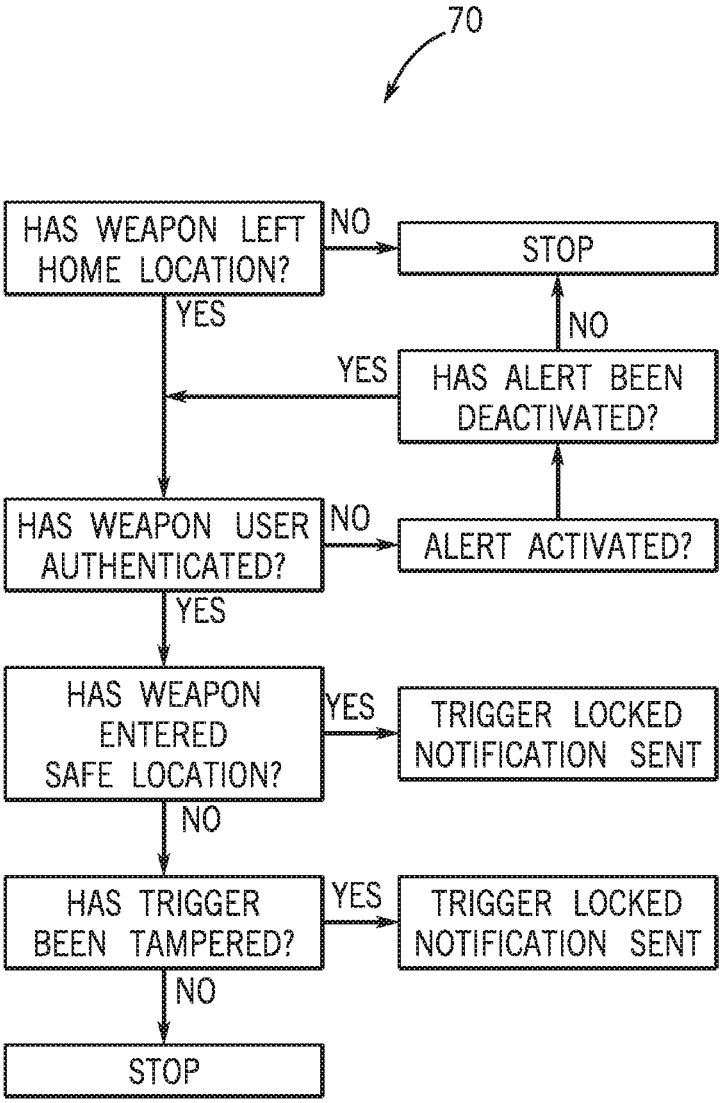
FIG. 7 is a flow chart of an exemplary embodiment of the present invention.

Referring to FIGS. 4A and 4B, the following process of joining the safe network system 10 includes the following:

1. Is there an active alert?

If yes, then all users in proximity whether they have joined the safe network system 10 or not will receive an alert message or notification based on threat. If no, then a join request initiated on set interval by computer/server 12. In certain embodiments, users must have installed the appropriate software application to receive the alert message; in other embodiments,.

2. Is mobile device in proximity does users have application software installed?

If yes, then the safe network system 10 sends the join request received. If no, then no join request sent to mobile devices.

3. Does mobile device accept request?

If yes, then user prompted for pass code. If no, then user not prompted any more to join.

4. Is pass code correct?

If no, then after three tries user must reset pass code. If yes, then user defined information added to computer/server 12 embodied by the safe network system 10.

5. Adjunct devices 16 connected to safe network system 10 monitored designated areas?
6. Safety Network server checks for alerts and notifications.

If no, then computer/server 12 takes no actions. If yes, then server identifies the following, safety alerting device, threat information received, safe location, and personal within danger zone.

7. Alerting activated notification sent to all networked devices and users based on threat location, pre-established groups are positions.
8. All networked devices updated to current threat level based on threat information received.

If within predetermined proximity of threat update to proper alert. If not within the predetermined proximity of threat initiate safe location indicator.

9. All peripheral computing devices 14 may be notified by the computers/servers 12. If within the predetermined proximity of threat, the peripheral computing devices 14 receive threat information on threat and directions to the safe location. If not, within the predetermined proximity of threat receive the threat info on threat.
10. Once threat has been resolved, the roll call functionality may be initiated. If all users appropriately respond to the roll call functionality, then the threat issue all clear. If all users do not appropriately respond to the roll call functionality, then respond identify GPS/IPS of unresponsive users initiated alerting for identified area.

Updated all adjunct devices 16 send notification to all peripheral computing devices 14.

In certain embodiments, roll call provides admin with a quick and easy way to quickly account for all personal after a crisis and during a crisis. Roll Call provides users with a safe location and information on the current crisis. Authentication ensures the integrity of the system. GPS and IPS data is utilized to locate individuals who do not respond to Roll Call request. Status updates are provided to Roll Call Admin as users respond or reach designated safe locations. Upon a failed check in or failure to reach safe location at designated time alerting is activated which, changes the check in interval to the default interval of 15 minutes, sends an SMS message to predetermined emergency contacts, emails emergency contacts, calls the first emergency contact on the emergency contact list, sends a 1 min audio and or video recording and provides the users last check in GPS/IPS location and their current location with their last message, and provides any calendar dates setup for that day. This continues until the alert has been deactivated by users' authentication such as biometric data, safe word, manual entering password, or manually entering user name and password, or entering a designated safe location. Manual alerting can also be triggered by activating a shake alert, safe word alert, Db alert, or push button alert.

11. When all users are located initiated all clear and set all adjunct devices 16 to original status.

Referring to FIGS. 2A through 7, the present invention may include the following functionalities: a first functionality adapted to identify threats to include type and location of the identified threat and provide safe routes to safe locations quickly with manual and automated notification triggers; a second functionality adapted to identify those in the proximity of the threat and those who have been injured and notifies the safe network system 10 (and local networks) and loved ones quickly manually or automatically; a third functionality adapted to focus on those who need help first so emergency responders don't waste needed time; a fourth functionality adapted to notify read receipt is received by users to verify help is on the way; a fifth modality adapted to manually or automatically quickly provides a way to account for all local or all users of a group quickly and authenticates said users for integrity; a sixth functionality adapted to notify all users that enter the proximity of the safety system to join the safety network through providing instruction and informational updates on crisis and be directed to safe locations based off their proximity to the threat even in locations that are foreign to them, wherein their manually added safety contacts will be provided updates in regards to their status; a seventh functionality adapted to require users to check-in at a predetermined interval or after leaving an identified safe location, so that when users fail to check in emergency contacts within a close proximity are notified automatically and are provided GPS/IPS data of current and a last check-in location with a user defined message and safety info based on alert type or user defined illness; a eighth functionality adapted to enable sensors, mobile devices, and stationary devices to capture active events based in part on set trigger thresholds that automatically send out notifications and record audio and video of local area, which may be sent to emergency contacts and responders; a ninth functionality adapted to provide default settings that allow quick usage and are ready to go once installed; a tenth functionality adapted to couple all systems together by utilizes, peripheral, stationary and mobile devices to create a vast safety network system, wherein emergency contacts don't have to download software.

The safe network system 10 may include a safety alert watch, a safety alert band, a mobile safety chip, security alerting and notification devices, firearm trigger freeze devices, safety aerial drones, and the like.

In certain embodiments, adjunct devices 16 can be configured to communicate with each other, creating a small local network that doesn't connect to the computers/servers 12 of the safe network system 10. In the small local networks, individual adjunct devices 16 may have the capability to monitor designated areas utilizing audio, video, motion, and sound. These adjunct devices 16 will have Wifi, Bluetooth and RIFD capabilities which could be used to connect up to a networked peripheral computing devices 14 to access command and control features similar to how the computers/servers 12 of the safe network system 10 to control adjunct devices 16. Server software can be designed to send request and information to mobile devices that don't have application software by going through wireless carriers. Wireless carriers can also be utilized to send out notifications and alerts to individuals or groups that are near a threat or potential threat or dangerous areas. They could, for example, utilize electronic signal carriers such as wireless, Analog, Digital, and Satellite, to disseminate the notification to all electronic devices, such as cell phones, PCs, tablets, laptops, gaming systems, cable TV, Smart TVs, hand held gaming devices, and other electronic devices that can receive or send signals to an electronic signal carrier. In certain embodiments, a safety alert watch utilizes smart watch technology and sensors to provide notifications and alerts during a crisis. SAW can be connected to a safety network to increase the users safe network and allow them to get active notification and status updates on the local area. These devices can activate alerts by motion triggers such as holding hands in the air. Said devices may use stress sensors to monitor heart rhythm and compare against recorded normal rhythms to determine distress and activate alerting. Alert triggers may be activated by safe words, screams, weapon fire, and safe location triggers. Deactivation of alerts may be accomplished by manually pressing the device, bio metric data, safe words, and safe locations. Notifications may go out to pre-established emergency contacts providing, GPS, IPS, current location, last check in location, type of threat, user defined message, and other helpful info to locate and determine threat or threats identified.

In certain embodiments, current Smart watches can be adapted to become SAW devices by downloading software and by connecting sensor technology devices to the smart devices such as smart bands and CIBS safety chips. Said devices will utilize stress sensors which will monitor heart rhythm and compare against recorded normal rhythms to determine distress and activate alerting. Stress reader may be specific to wearable mobile devices such as smart watches, smart bands, smart rings, smart necklaces, fitbits, and other wearable mobile devices. Sensors on these devices will pick up elevated heart rates indicating some form of stress for the wearer. Thresholds will be utilized to develop trigger points. Alerts and notifications will be provided via application servers, WiFi and Bluetooth technology to local contacts.

In certain embodiments, the present invention may include devices such as quad copters or aerial mobile automated devices that maneuver and monitor areas utilizing, audio, video, and motion to identify and track and tag threats and potential threats and provide alerts and notification to a safety network. These devices could be large to small in size. These devices could also be manually controlled. Devices that pickup weapons via their metallic signatures such as metal detectors which also can determine the type of weapon in close proximity or several feet away. Devices that have the capability to initiate preventative protective measures in the area of the threat such as smoke, tracking devices that can be fired at the threat and attached to the threats apparel and provide GPS and IPS data to the safety network to track the threat or threats. Bright light that renders the attacker immobile. Loud sound that is targeted and immobilizes the threat. Motion and video sensors that can identify threatening motions and weapons and trigger alerting and alarms automatically before weapon is discharged.

In certain embodiments, the present invention may include CIBS chips, wherein CIBS chips are small devices that can be attached to apparel, personal items, electronic devices, and the like. They may use RFD, WiFi and Bluetooth technology to provide alerts and notifications to computer/servers 12 and other peripheral computing devices 14. CIBS chips may receive notifications and alert users of localized threats via sound and or vibrations. CIBS chips may use sensors to activate alerts such as stress, noise, and motion sensors. Alerts can be activated by touch motion and sounds. Control device provides admin with the capability to, certify, deactivate alerts, and initiate alerting for all users. Control devices may be setup by downloading software to mobile devices. Security alerting notification devices may communicate with the computer/servers 12 and peripheral computing devices to provide alert and notification based on triggers activated by sound, motion, or manually by admin or users. SAN devices use a local rechargeable source or a power outlet. These devices are affixed throughout a building or along the exterior. Weapon trigger freeze device attaches to a weapons trigger and locks it when in a safe location.

In certain embodiments, the computer/server 12 will switch user interface based on what interface user has activated. For example, if a user sits their cell phone down and then activates a gaming console. User will be prompted if they would like to switch devices. Once the users accept and enters passcode the new device will get notifications and check in based on device. If it is gaming system users will be asked to check in during intermission or before and after gaming sessions. Once the user is done and turns off console application will go back to the original device user used before activating the gaming console. Gaming systems with voice activated commands will be modified to allow users to check in using voice commands or also send alerts via voice commands coupled with voice recognitions capabilities.

In certain embodiments, the present invention utilizes sensor on mobile devices and stationary adjunct devices to detect sound vibrations. Devices maintain database of Db levels and sound signatures that are setup to provide alerts and notifications based on Db level thresholds and signature matches. Devices can distinguish between, screams, gunshots, bombs, and attacks and background noises. Alerts can be activated in two ways. One a user says a safety phrase or word in their native language or a foreign language. The user says a set of identified danger words. For example, the users says, "No" in a loud tone alert level increases to Alpha and records data, the user then says "Stop" in a firm tone the alert level goes to Bravo another recording is taken emergency contacts receive an alert of a potential issue, the user then says "Don't" in a firm voice the alert level goes to Delta all emergency contacts are alerted and the alert notification mode is active. This mode will continue to send out data on a set interval and also live stream until the user says the deactivation safe word or manual deactivates the alert. The device will buzz or provide an audible alert to let the user know the alert mode is active. Alerts and notifications generated and provided to server for interpretation by server application. Server application initiates alerting and notification to peripheral devices to inform impacted users based on GPS and IPS technology. Updates are provided as sensors status change or when manual modification made by admin. This device also picks up, sounds such as slaps, gunshots, and yelling which all trigger alerts and nonfictions this can be detected by mobile devices or stationary devices.

In certain embodiments, the present invention utilizes Analog and Digital video cameras, wherein devices can be synced with server application to provide real time viewing of designated areas. Server application provides command and control of video cameras. Facial recognition and tagging allows for quick identification and tracking of identified threats and potential threats. For example, as an active shooter moves throughout a building users can tag their location or the user by taking a picture or video of the perpetrator as they move through the building. This will provide emergency responders with useful data to track the shooter.

In certain embodiments, the present invention GPS data is provided to emergency contacts via SMS and Email by server application. Users can check in by the following, safe word, safe phrase, voice recognition, facial recognition, manual passcode, finger print, retina scan, or safe location.

In certain embodiments, the present invention environmental trigger can be set off by local sensors to a facility or by notification from state ran emergency services. Db activated sensors can be triggered by bombs, shots fired, or attacking noises such as slaps. These sounds and vibrations are captured by stationary and mobile devices that are connected to servers by WiFi and Bluetooth technology.

In certain embodiments, the present invention news feeds from local media of active events and potential events impacting local areas will be collected by servers and modified and sent to peripheral devices. Users will receive safety information such as where the threat is in relevance to their current positon and where to go for safety. They will also receive information specific to the threat such as areas to avoid.

In certain embodiments, the present invention gun trigger freeze device is a peripheral device that will be activated once it enters the proximity of a location identified as being gun free such as schools, churches, government buildings, and commercial buildings. Firearms will be retrofitted with a device that will prevent the pulling of a fire arm trigger while in the proximity of a building or facility identified as gun free. The trigger device utilizes WiFi and Bluetooth technology to sync with stationary devices at gun free facilities. These devices detect the gun trigger freeze device and stops the trigger from being compressed. The device is retrofitted behind the trigger and utilizes a magnets and electronics to keep triggers in position when in the proximity of a gun free zone. Gun trigger freeze device also emits a red light to let users know they have entered a Gun Free zone. This device also provides notification that a user has tampered with the device or is attempting to pull the trigger. When the trigger is pulled in a Safe Zone the owner information along with the type of weapon and ammunition capacity is provide to the Safe Zones server and distrusted to admin. The safe trigger also locks when the weapon is removed from a designated home location if the user fails deactivate alert or someone other than the user has taken the weapon out of the home location.

A method of using the present invention may include the following. The safe network system 10 disclosed above may be provided. A user could utilize the present invention to provide safety notifications and alerts to impacted individuals and groups of people identified as being in close proximity of a threat. This could be done manually or be automated. Once a device's trigger threshold is reached a notification is sent to the wireless provider and then it is routed to the impacted individuals or groups. They can also notify emergency responders and provide both those in danger and the emergency responders with information on the threat. Such as, type of threat or threats, location of injured how many people are in the danger zone, locations that are safe, information on those who may have health issues or that may be elderly and need more assistance, best route to take to approach the threat, tips on aiding the injured, provide a roll call to check for everyone when threat has been eliminated. The present invention is not specific to one group, but can be used by all such as military, schools, individuals, hospitals and much more.

The computer-based data processing system and method described above is for purposes of example only, and may be implemented in any type of computer system or programming or processing environment, or in a computer program, alone or in conjunction with hardware. The present invention may also be implemented in software stored on a computer-readable medium and executed as a computer program on a general purpose or special purpose computer. For clarity, only those aspects of the system germane to the invention are described, and product details well known in the art are omitted. For the same reason, the computer hardware is not described in further detail. It should thus be understood that the invention is not limited to any specific computer language, program, or computer. It is further contemplated that the present invention may be run on a stand-alone computer system, or may be run from a server computer system that can be accessed by a plurality of client computer systems interconnected over an intranet network, or that is accessible to clients over the Internet. In addition, many embodiments of the present invention have application to a wide range of industries. To the extent the present application discloses a system, the method implemented by that system, as well as software stored on a computer-readable medium and executed as a computer program to perform the method on a general purpose or special purpose computer, are within the scope of the present invention. Further, to the extent the present application discloses a method, a system of apparatuses configured to implement the method are within the scope of the present invention.

It should be understood, of course, that the foregoing relates to exemplary embodiments of the invention and that modifications may be made without departing from the spirit and scope of the invention as set forth in the following claims.

What is claimed is:

1. A method of providing a safe network system, comprising:

prompting a plurality of peripheral computing devices and a plurality of adjunct devices to communicatively link to a network that includes at least one server, wherein prompting each device is based in part on a predetermined proximity to the network;

associating a user with each peripheral computing device;

the plurality of adjunct devices providing a plurality of sensors configured to identify at least one threat based on audio, visual and motion related data captured by the plurality of sensors;

the plurality of peripheral computing and adjunct devices providing global positioning system and indoor positioning system technology to locate at least one identified threat;

defining accountable peripheral computing devices from the plurality of peripheral computing devices based on a relative proximity of each peripheral computing device to each threat, and configuring each accountable peripheral computing device for communicating a plurality of threat alerts regarding and routes to a safe location relative to each identified threat, whereby focus is on users associated with accountable peripheral computing devices.

2. The method of claim 1, wherein the plurality of sensors comprises at least one of a group including motion sensor, a Db sensor, a light sensor, an audio sensor, and a video sensor.

3. The method of claim 1, wherein the at least one server automatically determines each safe location based on a spatial relationship between a respective peripheral computing device and the located position of the at least one identified threat.

4. The method of claim 1, wherein each adjunct device automatically communicates at least one of the plurality of threat alerts based in part on a breach of a predetermined threat threshold defined by the audio, visual and motion related data captured by the plurality of sensors.

5. The method of claim 4, wherein the at least one server automatically upgrades at least one of the plurality of threat alerts to a notification to emergency responders based in part on the predetermined threat threshold.

6. The method of claim 1, further providing a roll calling functionality based upon at least a status of the at least one identified threat, wherein the plurality of peripheral computing devices is prompted for a response, and wherein the roll calling functionality automatically terminates only when each peripheral computing device communicates the response.

7. A method of providing a safe network system, comprising:

prompting a plurality of peripheral computing devices and a plurality of adjunct devices to communicatively link to a network that includes at least one server, wherein prompting each device is based in part on a predetermined proximity to the network;

associating a user with each peripheral computing device;

the plurality of adjunct devices providing a plurality of sensors configured to identify at least one threat based on audio, visual and motion related data captured by the plurality of sensors, wherein the plurality of sensors comprises at least one of a group including motion sensor, a Db sensor, a light sensor, an audio sensor, and a video sensor;

the plurality of peripheral computing and adjunct devices providing global positioning system and indoor positioning system technology to locate at least one identified threat;

defining accountable peripheral computing devices from the plurality of peripheral computing devices based on a relative proximity of each peripheral computing device to each threat;

configuring each accountable peripheral computing device for communicating a plurality of threat alerts regarding and routes to a safe location relative to each identified threat; and providing a roll calling functionality based upon at least a status of the at least one identified threat, wherein each accountable peripheral computing devices is prompted for a response, and wherein the roll calling functionality automatically terminates only when each peripheral computing device communicates the response, wherein the at least one server automatically determines each safe location based on a spatial relationship between a respective accountable peripheral computing device and the located position of the at least one identified threat, wherein each adjunct device automatically communicates at least one of the plurality of threat alerts based in part on a breach of a predetermined threat threshold defined by the audio, visual and motion related data captured by the plurality of sensors, and wherein the at least one server automatically upgrades at least one of the plurality of threat alerts to a notification to emergency responders based in part on the predetermined threat threshold.

8. The method of claim 2, wherein each identified threat is identified based on a plurality of vibrations and sounds received by the Db and audio sensors.

9. The method of claim 8, wherein the plurality of vibrations and sounds define a slap.

10. The method of claim 8, wherein the plurality of vibrations and sounds define a gunshot.

11. The method of claim 8, wherein the plurality of vibrations and sounds define at least one yelling sound.

12. The method of claim 8, wherein the plurality of vibrations and sounds define at least one danger word.

13. The method of claim 8, wherein the plurality of sensors includes a metal detector for identifying a metallic signature of each identified threat.

14. The method of claim 2, wherein each identified threat is identified based on a gesture.

15. The method of claim 14, wherein the gesture is the holding hands in the air.

* * * * *